US005782669A

United States Patent [19]

Hornsby et al.

[11] Patent Number: 5,782,669

[45] Date of Patent: Jul. 21, 1998

[54] EYE ASSEMBLY FOR A STUFFED TOY OR THE LIKE

[75] Inventors: James Russell Hornsby, St. Louis; Joseph Lee McGowan, St. Peters; Tricia Souers, Florissant, all of Mo.

[73] Assignee: Trendmasters, Inc., St. Louis, Mo.

[21] Appl. No.: 720,350

[22] Filed: Sep. 27, 1996

[51] Int. Cl.[6] ..... A63H 3/40

[52] U.S. Cl. ..... 446/342

[58] Field of Search ..... 446/342, 372

[56] References Cited

U.S. PATENT DOCUMENTS

| | | | |
|---|---|---|---|
| 1,275,698 | 8/1918 | Kalvin | 446/342 |
| 1,948,803 | 2/1934 | Sherrill | 446/372 |
| 2,148,888 | 2/1939 | Wittmann | 446/342 |
| 2,660,830 | 12/1953 | Jentzen | 446/342 |
| 2,904,928 | 9/1959 | Bashover | 446/342 |
| 3,006,110 | 10/1961 | Neff et al. | 446/342 |
| 3,086,318 | 4/1963 | Brudney | 446/342 |
| 3,125,826 | 3/1964 | Ostrander | 446/342 X |
| 3,132,770 | 5/1964 | Freed | 446/342 X |
| 3,462,876 | 8/1969 | Kirschenmann | 446/342 X |
| 3,699,707 | 10/1972 | Sapkus | 446/342 X |
| 3,916,562 | 11/1975 | Burkhart | 446/342 X |
| 4,094,092 | 6/1978 | Bunin | 446/342 X |
| 4,560,363 | 12/1985 | Garza et al. | 446/342 |
| 5,399,115 | 3/1995 | Arad et al. | 446/342 |

*Primary Examiner*—William H. Grieb
*Attorney, Agent, or Firm*—Dorsey & Whitney LLP

[57] ABSTRACT

The present invention provides an eye assembly for a stuffed toy or the like. The eye assembly comprises a base member connected to the stuffed toy or the like, an eyeball connected to the base member and having a visible surface, an eyebrow, and an eyelid operably connected to the eyeball and selectively positionable with respect to the visible surface, whereby the demeanor or expression of the stuffed toy or the like may be changed.

4 Claims, 2 Drawing Sheets

EYE ASSEMBLY FOR A STUFFED TOY OR THE LIKE

BACKGROUND OF THE INVENTION

1. Field of the Invention

The present invention relates to amusement devices, particularly stuffed toys or dolls having a face.

2. Description of Related Art

As used herein, the terms doll(s) and stuffed toy(s) are intended to mean any reality-based or fanciful figurine for amusing people, especially, although not exclusively, children. Such figurines have been known for a long time. They have been and are made to represent or exhibit animal, human and imaginative forms. They may be caricatures or reproductions, and may be large or small, but typically they include at least some recognizably human or animal features, such as eyes.

Some dolls and stuffed toys have positionable or movable features, including limbs or facial features. Some attempt to replicate or at least imitate animal or human activity, including walking or other physical movement, making characteristic sounds or noises, talking or crying. U.S. Pat. Nos. 3,462,876 (Kirschenmann), 4,094,092 (Bunin), 3,125,826 (Ostrander), 3,916,562 (Burkhart), 3,699,707 (Sapkus) and 5,399,115 (Arad et al.) and 4,560,363 (Bjorklund et al.) disclose examples of dolls or figures which provide for changing facial expressions, including movable eyes and eyelids. Other examples of dolls with movable eye features are provided in U.S. Pat. Nos. 3,132,770 (Freed) and 3,086,318 (Brudney) wherein movable hemispherical shells or partial spheres, respectively, are used in the eye element to produce a movable eyelid effect. However, the dolls and figures disclosed in the preceding noted patents exhibit generally expensive, complex internal mechanisms., and may not be suitable for all figurines, particularly stuffed toys. It would be advantageous if there were an eye assembly available for dolls, stuffed toys and the like including an inexpensive, uncomplicated, safe selectively positionable eyelid for changing the expression and demeanor of the doll or toy.

SUMMARY OF THE INVENTION

The present invention provides an uncomplicated, inexpensive and safe eye assembly for a stuffed toy or the like. The eye assembly comprises an eyeball with a visible surface and an eyelid operably coupled to the eyeball, the eyelid being manually, selectively positionable with respect to the visible surface, whereby the demeanor of the stuffed toy or the like may be changed.

More specifically, the eye assembly includes a base member, an eyeball with a visible surface, and an eyelid for operably covering the visible surface and selectively positionable with respect thereto to change the amount of the visible surface which is visible, whereby the demeanor or expression of the stuffed toy or the like may be changed. The eyelid is made of flexible, fabric-like material and fits at least partially over the visible surface and behind the eyeball, which is then attached to the base member. The eye assembly is then fastened to the stuffed toy or the like.

The eyelid for the eye assembly includes an internal positioning stiffener which provides sufficient force to keep the eyelid, particularly its free edge, in a selected position relative to the visible surface of the eyeball.

It is an object of the present invention to provide an interactive amusement device, namely, a stuffed toy, having eyes and eyelids, wherein the eyelids may be selectively repositioned to change the demeanor of the device. Advantageously, this is accomplished without requiring an expensive, complex mechanism in or behind the eyes of the toy. Another advantage of the present invention is that, while it is intended for use primarily with "plush" or fabric type stuffed toys, it may be adapted for use with toys made from materials other than fabric.

Other objects and advantages of the present invention will become more fully apparent and understood with reference to the following description and to the appended drawings.

DETAILED DESCRIPTION OF THE PREFERRED EMBODIMENT

In this detailed description, the terms doll(s) and stuffed toy(s) are intended to mean any reality-based or fanciful toy with generally human, animal or imaginative facial features, particularly eyes. The terms doll(s) and stuffed toy(s) are particularly intended to encompass "plush" toys, i.e., those having a fabric skin defining a hollow interior which is then filled, usually with a compressible material, and usually taking the form of humans, animals or creatures of the imagination. The toy animal (a dog) depicted and described herein, at least in part (only the head is depicted), is made of an acrylic yarn and is intended to be representative of all types of plush or stuffed toys, as well as other dolls or figurines.

Any suitable fabric or fabric-like material (e.g., acrylic yarn), synthetic or natural, may used in forming the preferred embodiment of the toy of the present invention, and the eye assembly components therefore, and references to means for fastening, attaching or connecting components of the doll(s) and stuffed toy(s) of the present invention are intended to encompass conventional fastening means such as sewing or stitching, appropriate adhesives, application of heat or Velcro®-type connections. The preferred material for forming the eyelid of the present invention is a brushed, woven tricot. The material for making the base member and eyeball of the eye assembly of the present invention may be selected from appropriate materials such as various polymers, vinyls, plastics (including ABS-type material, which is preferred), wood and the like, and, for the eyelid and eyebrow, any suitable fabric or fabric-like material may be used. The material for making the positioning stiffener for the eye assembly of the present invention may be selected from any appropriate material which changes shape and/or size under force, but recovers its original configuration when the force is removed, i.e., any material with sufficient elasticity to help hold the eyelid in a selected position, including, for example, various polymers, rubber, plastics, metal or metallic alloys and the like, yet allow for the movement thereof. Generally, then, unless specifically otherwise disclosed or taught, the materials for forming the toy, particularly the eye assembly, of the present invention may be selected from appropriate materials or mixtures of materials, and thickness, texture, profile patterns and color can be selected as desired, as can the size of the toy and eye assembly.

Figure 1:
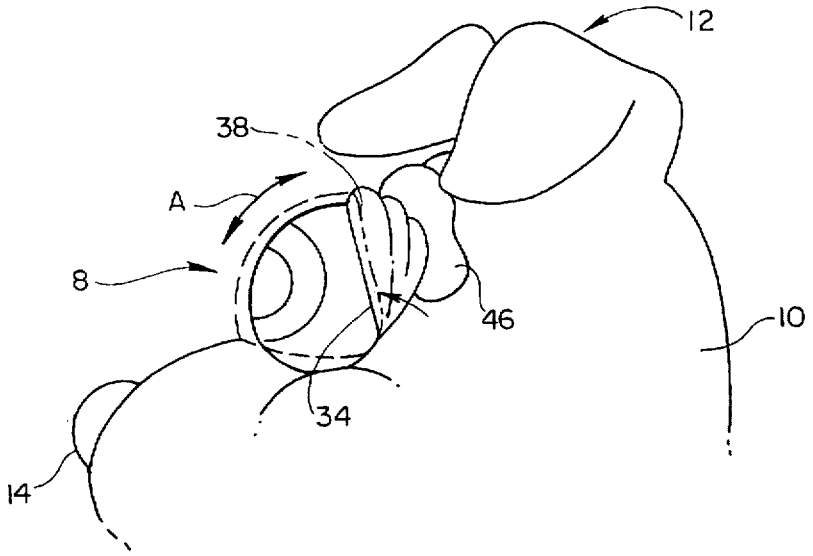
FIG. 1 is an perspective view of the head portion of a stuffed toy in accordance with the present invention, particularly the eye assembly thereof.

Referring to the drawings, particularly FIG. 1, the eye assembly 8 of the present invention is shown as it might be used on the face portion of the head 10 of a stuffed toy. The head 10 is, in this instance, the head of a stuffed dog, and includes a pair of ears 12, a nose 14, and, although only one is visible in the drawings, a pair of substantially identical eye assemblies 8.

Figure 2A:
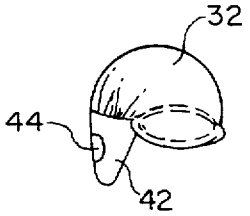
FIG. 2*a* depicts an alternative embodiment of the eyelid of the eye assembly.
Figure 2:
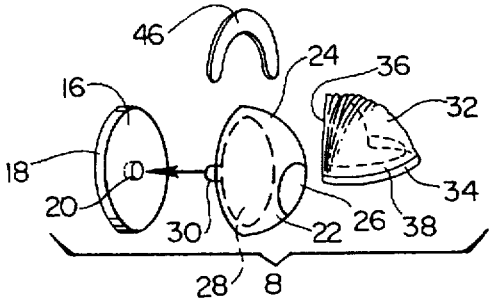
FIG. 2 is an exploded view of the eye assembly of the present invention.

Referring to FIG. 2, the eye assembly 8 includes a generally flat, disk-like base member 16 having a circular peripheral edge 18 and a generally central aperture 20. The eye assembly 8 also includes a generally hemispherical, solid, eyeball 22. The eyeball 22 has a front visible surface 24 carrying a pupil area 26. The eyeball 22 has a generally flat, rear mounting surface 28 with a generally central mounting tab 30 protruding therefrom. The eye assembly 8 includes an eyelid 32. Preferably, the eyelid 32 is made from a cloth-like fabric material and is a substantially continuous single piece. The eyelid 32 has a free, leading front edge 34 and a hidden rear attachment edge 36. Adjacent to and extending along the length of the leading edge 34, the eyelid 32 includes an internal, elongated elastic positioning stiffener or stiffening band 38.

Figure 2B:
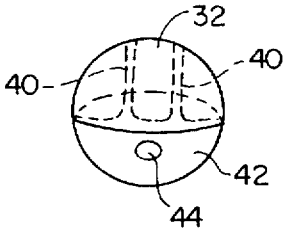
FIG. 2*b* depicts another alternative embodiment of the eyelid of the eye assembly.

FIGS. 2*a* and 2*b* depict alternative embodiments of the eyelid 32. FIG 2*a* depicts an eyelid 32 with an integral mounting flap 42 and FIG. 2*b* depicts an alternative embodiment of the eyelid 32 wherein the eyelid 32 includes a pair of generally deformable stiffening bands, both indicated at 40. The pair of bands 40 may be used in conjunction with or to replace the stiffener 38 parallel to the front edge 34 of the eyelid 32. The bands 40 depicted in FIG. 2*b* are transverse, generally perpendicular, with respect to the front leading edge 34, i.e., they extend from front to rear of the eyelid 32 as viewed in FIG. 1. Ideally, the bands are metal or plastic, show the effect of movement of the eyelid (opening and closing), extending or contracting with the movement, yet are stiff enough to hold or help hold the eyelid in a selected open, closed or partially closed position.

In the embodiments of the eyelid 32 depicted in FIGS. 2*a* and 2*b*, at its rear edge 36 the eyelid 32 includes an integral mounting flap 42 with a hole 44 for being received on the tab 30 to help secure the eyelid 32 in place in the eye assembly 8.

Referring back to FIG. 2, the eye assembly 8 includes an eyebrow 46 formed of a suitable fabric-like or cloth material.

Figure 3:
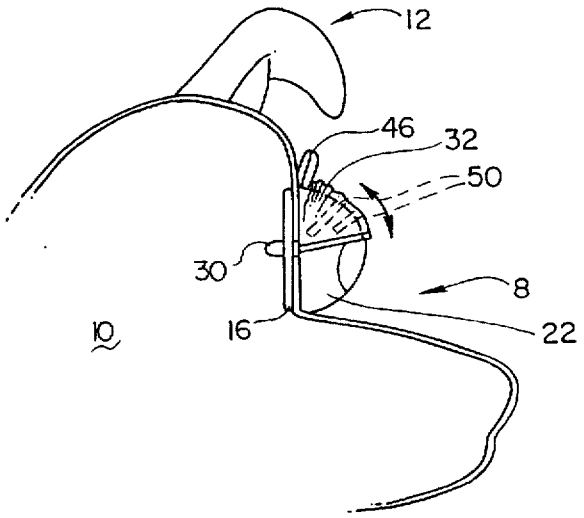
FIG. 3 depicts a stuffed toy in accordance with the present invention, particularly the eye assembly thereof, with portions of the stuffed toy broken away for clarity.

Referring to FIG. 3, the eye assembly 8 is depicted installed in the facial region of the head 10. Specifically, the mounting base member 16 is received inside the head 10 of the stuffed toy, i.e., immediately adjacent to the inside surface of the "skin" layer thereof. The eyelid 32 is positioned over at least a portion of the eyeball 22 with the hidden edge 36 adjacent or touching the flat rear side 28 of the eyeball 22. The eyebrow 46 may be positioned adjacent to the hidden edge 36 or, alternatively, it can be sewn directly to the head 10 of the stuffed toy. The tab 30 is received in the central hole 20 of the disk and the eyeball 22 is adhesively connected to the disk, capturing the hidden edge 36 of the eyelid 32 between the eyeball 22 and the disk 16, or skin of the stuffed toy and the disk 16. Note that in the embodiment of the present invention depicted in FIGS. 2*a* and 2*b*, the mounting hole of the flap would be captured on the tab 30 prior to the insertion of the tab 30 in the hole 20.

Referring back to FIG. 3, another embodiment of the eyelid 32 of the present invention is depicted. In this embodiment, the eyelid 32 includes an additional pair of stiffening strips, both indicated at 50. The additional strips 50 are generally parallel and spaced generally above and to the rear of the stiffener 38 along the leading edge 34.

Figure 4:
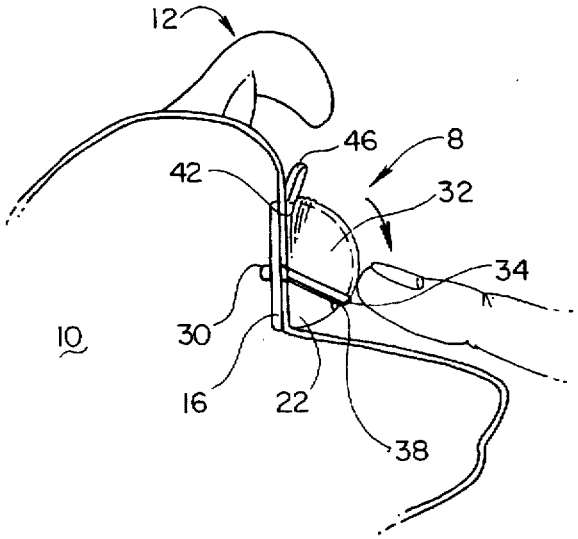
FIG. 4 is a view similar to that of FIG. 3 depicting the operation of the eyelid of the eye assembly of the present invention.

FIG. 4, portions of which are broken away to show the elastic or wire-like positioning stiffener 38 extending along the leading edge 34 of the eyelid 32, is provided to depict the use of the eye assembly 8, specifically the eyelid 32, of the present invention. The movement of the eyelid 32 is also depicted in FIG. 1, which includes arrow A to show the movement. In FIG. 1, the eyelid 32 is shown in a nearly fully open position with the leading edge 34 of the eyelid adjacent to the eyebrow 46. The eyelid 32 may be manipulated as depicted in FIG. 4, moving the leading edge 34 downwardly over the visible surface 24 of the eyeball 22. This gives the toy of the present invention a sleepy demeanor. Friction between the eyelid 32 and the eyeball 22 serves in part to retain the eyelid 32 in the position depicted in FIG. 4 after letting it go. The tension or force exerted by the elastic positioning stiffener 38 around the curved eyeball 22 also helps to hold the eyelid 32 in its selected position.

Although a "plush" toy is depicted, it should be clear that the eye assembly 8, particularly the eyelid 32 arrangement, could be adapted for use with any doll or stuffed toy. The eyeball 22 is depicted as solid, but may be hollow. The eyelid 32 may mounted in the eye assembly 8 by having its rear edge 36 trapped or held between the base member and the rear side 28 of the eyeball 22, and/or the rear edge 36 may be adhesively connected to the rear side 28. Adhesive may also be used with the eyelid embodiment 32 depicted in FIGS. 2*a* and 2*b*. The positioning stiffener 38 may be a wire-form or flattened elastic material, and it may be connected, at or adjacent to its ends, directly to the eyeball 22 or the base 16.

The preceding description and the appended drawings are provided to illustrate and describe the preferred embodiment of the eye assembly of the present invention. Although a description of the preferred embodiment has been presented, various changes, including those mentioned above, could be made without deviating from the spirit of the present invention. It is desired, therefore, that reference be made to the appended claims rather than to the foregoing description to indicate the scope of the invention.

What is claimed is:

1. An eye for a stuffed toy or the like having a face, said eye comprising:

an eyeball with an eyeball surface; and an eyelid operably coupled to the eyeball for being selectively positioned with respect to the eyeball surface, wherein the eyelid comprises a substantially continuous piece of material having a free edge movable with respect to the eyeball, and positioning means for tending to keep the eyelid in a selected position, said positioning means comprising a stiffener, at least a portion of the stiffener adjacent to the free edge.

2. The eye according to claim 1, wherein the positioning means comprises an elastic stiffener adjacent to and extending along at least a portion of the free edge.

3. The eye according to claim 1, wherein the positioning means comprises an elongated wire-like stiffener adjacent to and extending along at least a portion of the free edge.

4. The eye according to claim 1, wherein the positioning means comprises at least one stiffener generally transverse to said free edge.

* * * * *